US007847785B2

(12) United States Patent
Tanaka

(10) Patent No.: US 7,847,785 B2
(45) Date of Patent: Dec. 7, 2010

(54) BACKLIGHT DEVICE

(75) Inventor: Shinichi Tanaka, Tokyo (JP)

(73) Assignee: Texas Instruments Incorporated, Dallas, TX (US)

( * ) Notice: Subject to any disclaimer, the term of this patent is extended or adjusted under 35 U.S.C. 154(b) by 356 days.

(21) Appl. No.: 12/118,406

(22) Filed: May 9, 2008

(65) Prior Publication Data

US 2009/0174331 A1 Jul. 9, 2009

(30) Foreign Application Priority Data

May 10, 2007 (JP) ..... 2007-125146

(51) Int. Cl.
*G09G 3/36* (2006.01)

(52) U.S. Cl. ..... 345/102; 315/308; 356/222

(58) Field of Classification Search ..... 345/87, 345/102; 315/291, 307, 308; 356/218, 222
See application file for complete search history.

(56) References Cited

U.S. PATENT DOCUMENTS

| | | | | |
|---|---|---|---|---|
| 7,324,080 | B1 * | 1/2008 | Hu et al. | 345/102 |
| 7,468,721 | B2 * | 12/2008 | Nakano | 345/102 |
| 7,714,497 | B2 * | 5/2010 | Haga et al. | 313/498 |
| 2007/0120808 | A1 * | 5/2007 | Shimoda et al. | 345/102 |
| 2008/0238863 | A1 * | 10/2008 | Nishigaki | 345/102 |
| 2009/0303467 | A1 * | 12/2009 | Ashdown et al. | 356/217 |

FOREIGN PATENT DOCUMENTS

| | | | |
|---|---|---|---|
| JP | 19027138 | A | 1/2007 |
| KR | 1020060094045 | A | 8/2006 |
| KR | 1020070077272 | A | 7/2007 |

OTHER PUBLICATIONS

PCT/US2008/063411 Search Report dated Aug. 27, 2008.

* cited by examiner

*Primary Examiner*—Thuy Vinh Tran
(74) *Attorney, Agent, or Firm*—William B. Kempler; Wade J. Brady, III; Frederick J. Telecky, Jr.

(57) ABSTRACT

A circuit to appropriately adjust the emission intensity of LEDs of various colors. By means of a first optical sensor (11), the detection range of which includes the peak wavelengths of LEDs ($\mathbf{10}_R$), ($\mathbf{10}_G$), and ($\mathbf{10}_B$) of multiple colors and the detectable peak wavelength of which is shorter than the shortest peak wavelength of the LEDs ($\mathbf{10}_R$), ($\mathbf{10}_G$) and ($\mathbf{10}_B$), and a second optical sensor 12 the detectable peak wavelength of which is longer than the longest peak wavelength of the LEDs ($\mathbf{10}_R$), ($\mathbf{10}_G$), and ($\mathbf{10}_B$), the LEDs ($\mathbf{10}_R$), ($\mathbf{10}_G$), and ($\mathbf{10}_B$) of each color are lighted one color at a time and the emission intensity is measured. When the measurement result of the first optical sensor (11) indicates an increase and the measurement result of the second optical sensor indicates a decrease, it is known that the emitted light has shifted to a shorter wavelength, and in the opposite case, that it has shifted to a longer wavelength. In the case of a change in intensity rather than a shift in the emitted wavelength, the measurement results of both first optical sensor (11) and second optical sensor (12) will be a decrease or an increase, so that a shift can be discriminated from a change in intensity, and can be detected.

20 Claims, 3 Drawing Sheets

BACKLIGHT DEVICE

FIELD OF THE INVENTION

The present invention relates generally to the technical field of LED backlighting; in particular, it relates to a technique for correcting color shifts in white light caused by deviations in LED characteristics.

BACKGROUND OF THE INVENTION

Due to their long service life and low power consumption, LEDs are gaining attention as backlights for liquid-crystal display devices. In recent years, in addition to being used as liquid-crystal display devices for mobile phones, they have begun to be used as liquid-crystal display devices for TVs. In a backlight panel that uses LEDs, red, green and blue LEDs are provided on a substrate, and by lighting the LEDs for each color at the same time the three colors are combined to create white light.

While each LED is lit, the emission intensity for each color can be changed by repeatedly turning them on and off rapidly at a fixed frequency and changing the on/off ratio or the value of the constant current that flows while they are lit. An optical sensor for red, an optical sensor for green, and an optical sensor for blue are provided on the substrate, and when each LED is lit and the white light that is produced is incident on each sensor, each optical sensor measures the intensity of the light for each color, red, green, blue, and the emission intensity for each color is adjusted to obtain natural white light.

However, in addition to cases in which the emission intensity is reduced due to deterioration, there are cases in which the peak intensity wavelength (the peak wavelength) of the emitted light of an LED shifts due to temperature changes during use. When the wavelength shifts, the precise light intensity cannot be detected with an optical sensor, the sensitivity of which is adjusted for each color, the emission ratio for each color cannot be adjusted, and white light cannot be obtained; thus, a solution is desired.

SUMMARY OF THE INVENTION

A general object of the present invention is to solve or reduce the problem of the prior art; it offers a technique in which a change in the peak wavelength of an LED can be detected.

This and other objects and feature are provided, in accordance with an aspect of the present invention is a backlight device comprising: multiple LEDs with different peak wavelengths or wavelengths of maximum emission intensity; a drive circuit for the purpose of driving the multiple LEDs; and first and second optical sensors that detect the light intensity of the light emitted from the multiple LEDs; wherein the detection range of the first and second optical sensors includes the peak wavelengths of the multiple LEDs, and the wavelength of the maximum detection sensitivity of the first optical sensor is located at a shorter wavelength than the shortest of the peak wavelengths, and the wavelength of the maximum detection sensitivity of the second optical sensor is located at a longer wavelength than the longest of the peak wavelengths.

In addition, an aspect of the present invention is a backlight device, for which the drive circuit causes the multiple LEDs to emit all colors of light during the period that the backlight emits light, and causes the multiple LEDs to emit one color of light at a time during a measurement period.

In addition, an aspect of the present invention is a backlight comprising multiple LEDs, including a red LED, a green LED and a blue LED; a drive circuit for the purpose of driving the multiple LEDs to emit light; and an optical sensor for the purpose of detecting the emission intensity of the multiple LEDs; wherein the backlight outputs white light; and wherein one of the red, green, or blue LEDs is driven to emit light during the vertical retrace period or the horizontal retrace period of a display device, the emission intensity of one of the red, green, or blue LEDs is measured by means of the optical sensor, and the emission intensity of each LED is adjusted based on the result of said measurement.

REFERENCE NUMERALS AND SYMBOLS AS SHOWN IN THE DRAWINGS

In the figures, 1 represents a backlight panel, $\mathbf{10}_R$, $\mathbf{10}_G$, $\mathbf{10}_B$ represents LEDs, 11 represents a first optical sensor, 12 represents a second optical sensor, 15 represents a drive device.

DESCRIPTION OF THE EMBODIMENTS

Because the emission intensity of each LED can be detected with a simple configuration, the emission intensity of each color can be adjusted to the optimal intensity for obtaining white light. Because the number of optical sensors is reduced, the cost is decreased.

Figure 1:
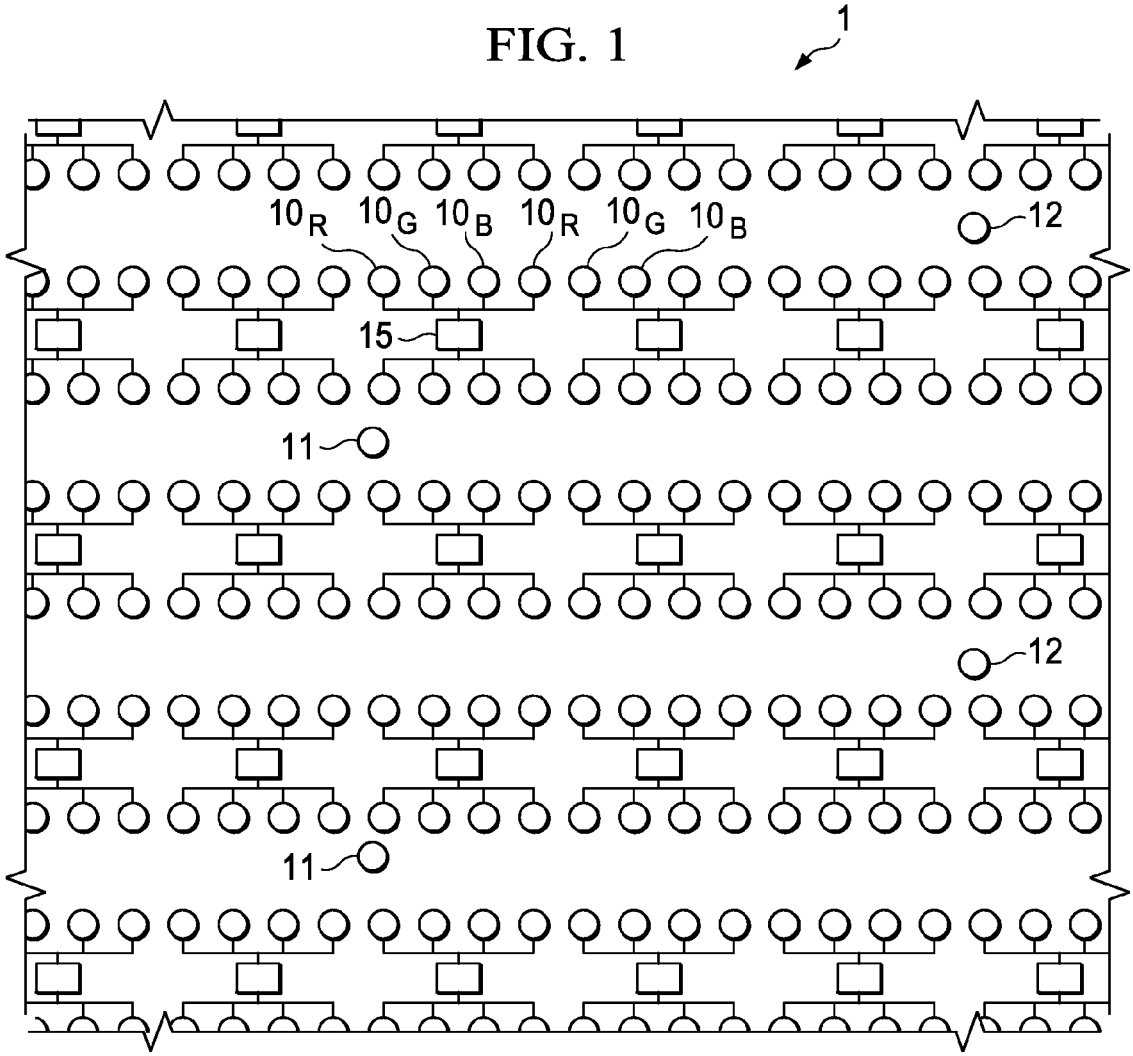
FIG. 1 is a plan view for the purpose of explaining the backlight panel of the present invention.

In FIG. 1, 1 indicates the backlight panel (backlight device) of the present invention.

This backlight panel 1 has multiple red LEDs $\mathbf{10}_R$, green LEDs $\mathbf{10}_G$, and blue LEDs $\mathbf{10}_B$ that respectively emit one of the colors red, green, or blue. Red, green, and blue LEDs $\mathbf{10}_R$, $\mathbf{10}_G$, and $\mathbf{10}_B$ are arranged regularly on the substrate, and a drive device (drive circuit) 15 is arranged between each LED $\mathbf{10}_R$, $\mathbf{10}_G$, and $\mathbf{10}_B$.

Red, green, and blue LEDs $\mathbf{10}_R$, $\mathbf{10}_G$, and $\mathbf{10}_B$, are driven with a constant current by means of drive devices 15, to emit light. The red, green, and blue LEDs $\mathbf{10}_R$, $\mathbf{10}_G$, and $\mathbf{10}_B$ light up together, and when their emitted light combines, white light is produced and the rear surface of the liquid-crystal elements are illuminated with the emitted light.

First and second optical sensors 11, 12, which detect the emission intensity of the received light, are arranged at a location illuminated by the emitted light of each red, green, and blue LED $\mathbf{10}_R$, $\mathbf{10}_G$, and $\mathbf{10}_B$, at a location between LEDs $\mathbf{10}_R$, $\mathbf{10}_G$, and $\mathbf{10}_B$.

Figure 2:
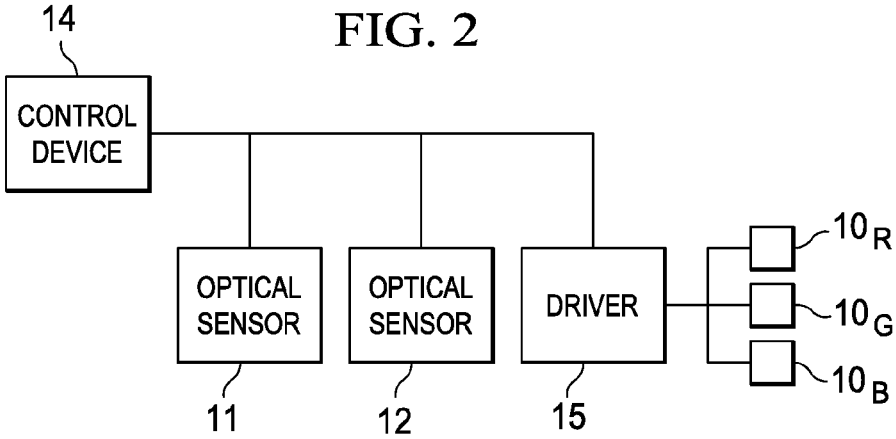
FIG. 2 is a circuit block diagram of the backlight panel of the present invention.

FIG. 2 is a circuit block diagram of this backlight panel 1; drive device 15 and the first and second optical sensors 11, 12 are connected by means of a control device 14.

The intensity of the received light measured by first and second optical sensors 11, 12 is input to control device 14, and based on the measurement result, the emitted light of each red, green and blue LED $10_R$, $10_G$, and $10_B$ is controlled by a drive device 15, as explained below.

Figure 4:
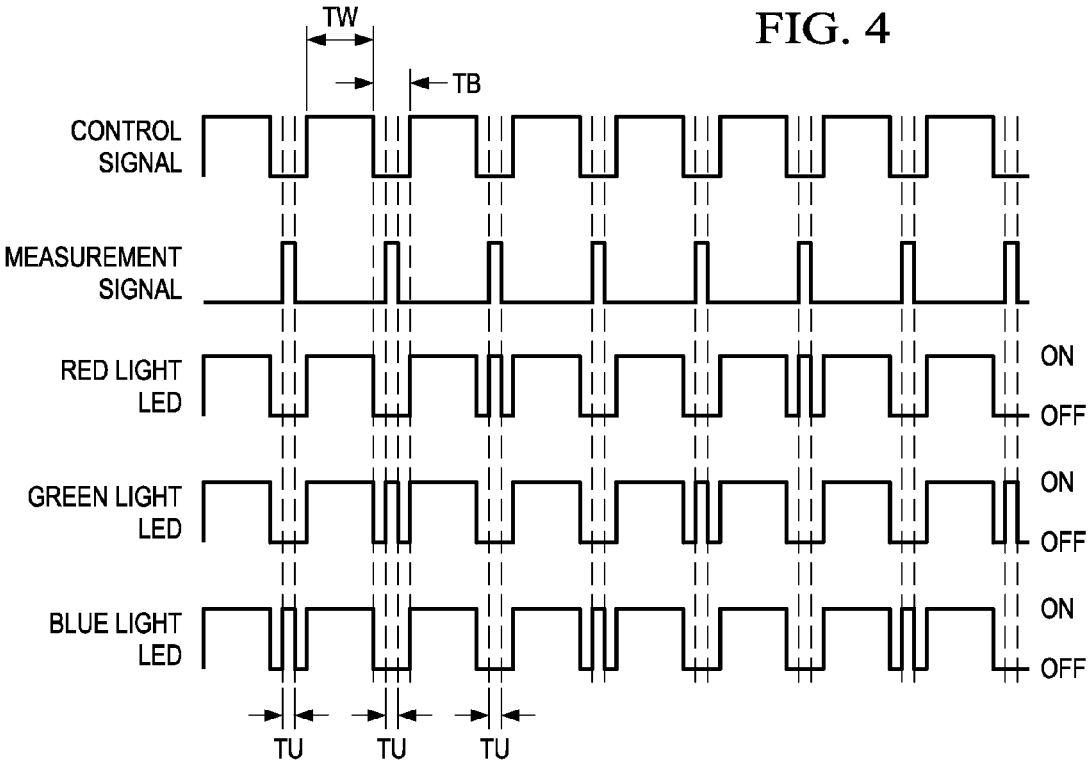
FIG. 4 is a timing diagram for the purpose of explaining an example of the relationship between the light emission period and the measurement period.

First, the operation of each LED $10_R$, $10_G$, and $10_B$ will be explained. A control signal and a measurement signal with the waveforms shown in the timing diagram of FIG. 4 are input to LED drive device 15.

With this control signal, an emission time TW, during which multiple LEDs $10_R$, $10_G$, and $10_B$ of all three colors are on together to produce white light, and an extinguish time TB, during which each of LEDs $10_R$, $10_G$, and $10_B$ is off, are set. Due to the residual image effect of the human eye, the repetition rate, one period of which comprises the emission time TW and the extinguish time TB, is preferably 60 Hz or higher; in the present example, this repetition rate is synchronized with the vertical synchronizing signal of the liquid-crystal display device, and the extinguish time is assigned to the vertical retrace period. Moreover, the repetition rate can be synchronized with the horizontal synchronizing signal of the liquid-crystal display device and the extinguish time can be assigned to the horizontal retrace period.

The on time TU for a single color, during which any one of the color LEDs $10_R$, $10_G$, or $10_B$ is on, is set by the measurement signal. The single-color on-time TU is assigned to the vertical retrace period, and when drive device 14 causes any one of the color LEDs $10_R$, $10_G$, or $10_B$ to light in response to the measurement signal, the first and second optical sensors 11, 12 are illuminated with the light emitted from the LED $10_R$, $10_G$, or $10_B$, and first and second optical sensors 11, 12 measure the light intensity of the received light.

Figure 3:
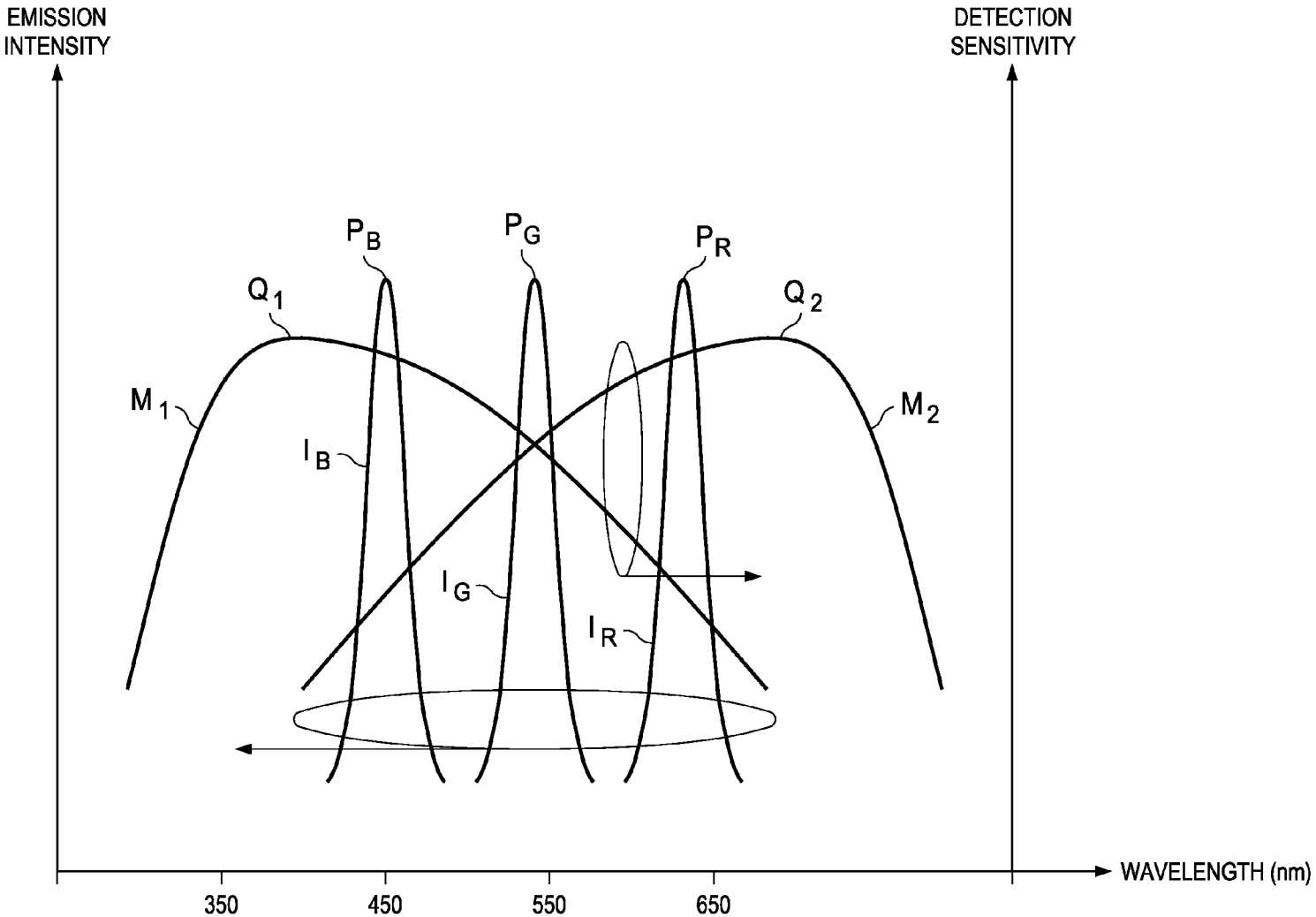
FIG. 3 is a graph for the purpose of explaining the relationship between the range of detected wavelengths of the optical sensors and the peak wavelengths of the LEDs.

FIG. 3 is a graph illustrating the relationship between the wavelength of light and the emission intensity for each LED and the wavelength of light and the detection sensitivity for the optical sensors. The symbols $I_R$, $I_G$, and $I_B$ are respectively curves indicating the relationship between the wavelength and the intensity of the emitted light of red, green, and blue LEDs $10_R$, $10_G$, and $10_B$; the symbols $M_1$, $M_2$ are respectively curves indicating the relationship between the wavelength of light and the detection sensitivity of first and second optical sensors 11, 12.

Moreover, the symbols $P_R$, $P_G$, $P_B$ respectively indicate the maximum intensity (peak intensity) of the emitted light of red, green, and blue LEDs $10_R$, $10_G$, and $10_B$, and the symbols $Q_1$, $Q_2$ are respectively the highest point of the detection sensitivity of first and second optical sensors 11, 12.

For first and second optical sensors 11, 12, the values of the light wavelengths at which the detection sensitivity is highest differ, and when the optical sensor for which that wavelength is on the short wavelength side is made first optical sensor 11 and the optical sensor for which that wavelength is on the long wavelength side is made second optical sensor 12, the peak wavelength of the detection sensitivity of first optical sensor 11 is set to a shorter wavelength than the peak wavelength of the emission intensity of the shortest wavelength LED $10_B$, and the peak wavelength of the detection sensitivity of second optical sensor 12 is set to a longer wavelength than the peak wavelength of the emission intensity of the longest wavelength LED $10_R$.

Moreover, the range of the detection sensitivity of first and second optical sensors 11, 12 is from the peak wavelength of the shortest wavelength LED (herein, blue LED $10_B$) to the peak wavelength of the longest wavelength LED (herein, red LED $10_R$), inclusive; accordingly, as shown in FIG. 4, when LEDs $10_R$, $10_G$, and $10_B$ are lighted one color at a time per single-color on-time TU, the emission intensity can be measured for each color with both first and second optical sensors 11, 12.

The measurement results of first and second optical sensors 11, 12 are recorded in control device 14 for each color, and an increase or decrease in the emission intensity can be detected by calculating a change in the recorded content.

For the color LEDs $10_R$, $10_G$, and $10_B$ (red, green blue LEDs), when the peak wavelength of the emitted light of any of the LEDs $10_R$, $10_G$, and $10_B$ shifts to the short wavelength side, it is detected as an increase in emission intensity at first optical sensor 11, and as a decrease in intensity at second optical sensor 12.

Conversely, when the peak wavelength shifts to the long wavelength side, it is detected as a decrease in emission intensity at first optical sensor 11, and as an increase in intensity at second optical sensor 12.

Thus, if the light intensity detected by the optical sensors changes without a change in the value (emission intensity) of the peak wavelength of the emitted light of the LEDs, it is known that the frequency of the emitted light of the LEDs has shifted to the short wavelength side when the intensity detected by first optical sensor 11 increases, and when it decreases, that the frequency of the emitted light of the LED has shifted to the long wavelength side.

On the other hand, if the emission intensity increases or decreases without a shift in the peak wavelength of the emitted light of the LEDs, this can be detected as an increase or a decrease in both of the detection results of first and second optical sensors 11, 12.

Accordingly, a shift in the peak wavelength of the emitted light of an LED and an increase or decrease in the peak intensity of the emitted light of an LED can be discriminated and detected. In this case, it is possible also to use a configuration in which notification of a change in the emission intensity or of a deviation in the frequency of the emitted light is provided to the outside by control device 14.

LED drive device 15 is controlled by control device 14; by controlling LED drive device 15 with control device 14 based on the detection result, the emission intensity of the LEDs $10_R$, $10_G$, and $10_B$ of each color can be adjusted to produce white light.

When the emission intensity is adjusted by performing on/off control of the LEDs $10_R$, $10_G$, and $10_B$ of each color during the emission period at a frequency that is several times greater than the repetition rate, the emission intensity can be adjusted by changing the on-time to off-time ratio.

Moreover, when LEDs $10_R$, $10_G$, and $10_B$ emit light, LED drive device 15 performs control such that a constant current flows in LEDs $10_R$, $10_G$, and $10_B$; however, by changing the magnitude of the constant current, the emission intensity of each LED $10_R$, $10_G$, and $10_B$ can be changed.

Figure 5:
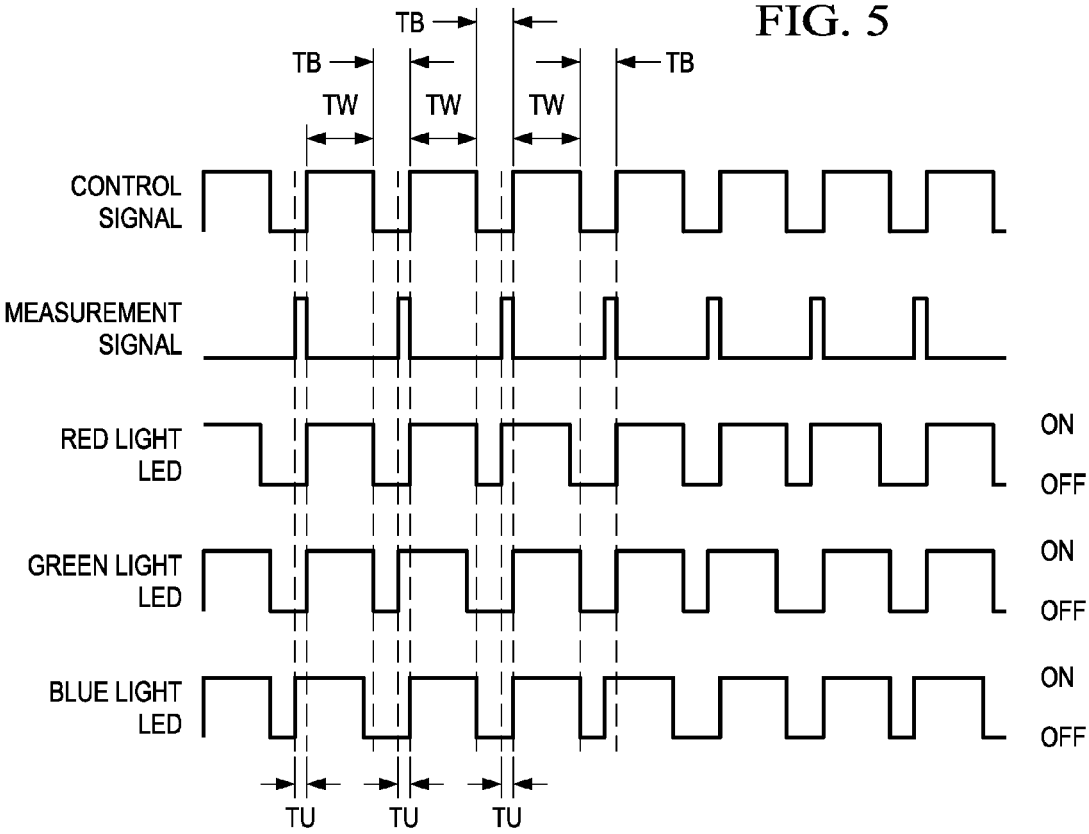
FIG. 5 is a timing diagram for the purpose of explaining another example of the relationship between the light emission period and the measurement period.

FIG. 5 is a timing diagram illustrating another example of the measurement period for the emitted light of red, green, and blue LEDs $10_R$, $10_G$, and $10_B$. In this example, the emission start time for only one color is cyclically moved ahead by means of the measurement signal supplied during the vertical retrace period, and this time is called the single-color on-time TU. During single-color on-time TU, the other colors are off; the emission intensity for each color is measured by means of first and second optical sensors 11, 12, and shifts in the peak wavelength or changes in the peak intensity are measured by means of control device 14.

Note that in this example, to make the emission period for the LEDs $10_R$, $10_G$, and $10_B$ of each color identical, the LED $10_R$, $10_G$, or $10_B$ for which the single-color on-time TU is set turns off at the single-color on-time TU before the other LEDs $10_R$, $10_G$, or $10_B$, turn off.

Next, other preferred embodiments of the present invention will be explained. In the example, the emission intensity of each LED was measured using two optical sensors; however, a configuration in which one optical sensor having a sensitivity to each color of light, red, green, blue, can be used. In this case, each LED respectively emits light independently during the vertical retrace period, and the emission intensity of each LED can be measured by measuring the emission intensity at this time by means of time division. By detecting the emission intensity and adjusting the emission intensity of each LED based on the detection result, the desired white light can be obtained. When only one optical sensor is used, a shift in the frequency of the emitted light of each LED cannot be detected; however, because there is only one optical sensor, costs can be reduced.

With the present invention, the configuration is such that the emission intensity of each LED is detected by lighting each red, green, blue LED one by one by means of time division, so that there is no need to install a special color filter on the optical sensor; thus, a low-cost system can be offered.

In the examples, one of the LEDs of each color, red, green, or blue is lighted during one vertical retrace period (or horizontal retrace period), and the emission intensity of the LEDs of each color is measured when the three vertical retrace periods are completed; however, the configuration can be such that each of the three LEDs is respectively lighted independently by means of time division during one vertical retrace period (or horizontal retrace period) and the emission intensity of the three LEDs is measured during one vertical retrace period.

In the foregoing, a case wherein backlight panel 1 produces white light with three colors was explained; however, the present invention is not limited to three colors: backlight panels that produce white light with LEDs of four or more colors are included in the present invention.

While the invention has been shown and described with reference to preferred embodiments thereof, it is well understood by those skilled in the art that various changes and modifications can be made in the invention without departing from the spirit and scope of the invention as defined by the appended claims.

The invention claimed is:

1. A backlight device comprising:

A plurality of LEDs with different peak wavelengths;

a drive circuit for driving the plurality of LEDs;

first and second optical sensors that detect light intensity of the light emitted from the plurality of LEDs, wherein the detection range of the first and second optical sensors includes the peak wavelengths of the plurality of LEDs, and wherein the wavelength of the maximum detection sensitivity of the first optical sensor is located at a shorter wavelength than the shortest of the peak wavelengths, and the wavelength of the maximum detection sensitivity of the second optical sensor is located at a longer wavelength than the longest of the peak wavelengths.

2. The backlight device of claim 1, wherein the drive circuit causes the plurality of LEDs to emit all colors of light during the period that the backlight emits light, and causes the plurality of LEDs to emit one color of light at a time during a measurement period.

3. A backlight comprising:

A plurality of LEDs, including a red LED, a green LED and a blue LED;

a drive circuit for driving the plurality of LEDs to emit light; and an optical sensor for the purpose of detecting the emission intensity of the plurality of LEDs; and that outputs white light as a backlight, wherein one of the red, green, or blue LEDs is driven to emit light during a vertical retrace period or a horizontal retrace period of a display device, the emission intensity of the one of the red, green, or blue LEDs is measured by the optical sensor, and the emission intensity of each LED is adjusted based on the result of said measurement.

4. The backlight device of claim 3, wherein the measurement of the emission intensity is performed for one of the red, green, or blue LEDs during one vertical retrace period or horizontal retrace period.

5. The backlight device of claim 4, wherein the emission intensity of each LED is measured by means of one optical sensor.

6. The backlight device of claim 4, wherein the emission intensity of each LED is measured by two different optical sensors.

7. The backlight device of claim 3, wherein the measurement of the emission intensity is performed for each LED of the red, green, and blue LEDs during one vertical retrace period or horizontal retrace period.

8. The backlight device of claim 7, wherein the emission intensity of each LED is measured by means of one optical sensor.

9. The backlight device of claim 7, wherein the emission intensity of each LED is measured by two different optical sensors.

10. The backlight device of claim 3, wherein the emission intensity of each LED is measured by means of one optical sensor.

11. The backlight device of claim 10, wherein the emission intensity of each LED is measured by two different optical sensors.

12. The backlight device of claim 3, wherein the emission intensity of each LED is measured by two different optical sensors.

13. A driver for a backlight comprising:

a drive circuit for driving a plurality of LEDs, each LED having a different peak wavelength;

an optical sensor to detect light intensity of the light emitted from the LEDs;

a control circuit for driving one of the LEDs during a vertical retrace period or a horizontal retrace period during which light intensity of the driven LED is measured and the emission intensity adjusted.

14. The driver of claim 13 wherein the optical sensor comprises a plurality of optical sensors each having a maximum sensitivity at a different wavelength.

15. The backlight device of claim 14, wherein the measurement of the emission intensity is performed for one of the red, green, or blue LEDs during one vertical retrace period or horizontal retrace period.

16. The backlight device of claim 14, wherein the measurement of the emission intensity is performed for each LED of the red, green, and blue LEDs during one vertical retrace period or horizontal retrace period.

17. The backlight device of claim 13, wherein the measurement of the emission intensity is performed for one of the red, green, or blue LEDs during one vertical retrace period or horizontal retrace period.

18. The backlight device of claim 13 wherein the measurement of the emission intensity is performed for each LED of the red, green, and blue LEDs during one vertical retrace period or horizontal retrace period.

19. The backlight device of claim 13, wherein the emission intensity of each LED is measured by means of one optical sensor.

20. The backlight device of claim 13, wherein the emission intensity of each LED is measured by two different optical sensors.

* * * * *